United States Patent [19]

MacKellar et al.

[11] 4,099,467

[45] Jul. 11, 1978

[54] SEQUENTIAL INITIATION OF EXPLOSIONS

[75] Inventors: Jeremy Margreave MacKellar, Benoni; Christopher Michael Dryden; Peter Alan Brazendale, both of Cape Town, all of South Africa

[73] Assignee: Plessey S.A. Limited, Cape Town, South Africa

[21] Appl. No.: 748,438

[22] Filed: Dec. 8, 1976

[30] Foreign Application Priority Data

Dec. 23, 1975 [ZA] South Africa ..... 75/7981

[51] Int. Cl.[2] ..... F42C 15/40

[52] U.S. Cl. ..... 102/217

[58] Field of Search ..... 102/70.2 R

[56] References Cited

U.S. PATENT DOCUMENTS

| | | | |
|---|---|---|---|
| 3,262,388 | 7/1966 | McCarty | 102/70.2 R |
| 3,468,255 | 9/1969 | Stryker, Jr. | 102/70.2 R |
| 3,722,418 | 3/1973 | Hoffmann | 102/70.2 R |
| 3,805,115 | 4/1974 | Heckelman | 102/70.2 R |
| 3,808,459 | 4/1974 | Guimier et al. | 102/70.2 R |
| 3,934,514 | 1/1976 | Dawkins | 102/70.2 R |

*Primary Examiner*—Charles T. Jordan

*Attorney, Agent, or Firm*—Ladas, Parry, Von Gehr, Goldsmith & Deschamps

[57] ABSTRACT

This invention provides a method and apparatus for electrically, sequentially activating a sequence of initiators, to sequentially initiate a series of explosions, such as in blasting or with propellants. The invention provides a series of activating modules that each has a switch which is disabled by the preceding activating module until the initiator of the said preceding module has been activated. The activating modules are further arranged in sets so as to be selectively energized from a suitable power supply. In a preferred form the switches are uni-directional and the activating modules are connected between a pair of supply cables with the switches of alternate modules being of opposite polarity. The activating modules are then selectively energized by reversing the polarity of the power supply. In an alternative form the activating modules are connected to have a common power return cable with the activating modules of each set being connected to individual power drive cables. Thus the manner of sequential operation and the timing intervals between the initiations is controlled by the manner in which power is supplied.

23 Claims, 7 Drawing Figures

SEQUENTIAL INITIATION OF EXPLOSIONS

This invention relates to the sequential initiation of explosions. More particularly the invention relates to the sequential activation, by electrical means, of electrically operable initiators, to sequentially initiate a series of explosions. Accordingly, this invention relates to an electrically operable means for sequentially activating, by electrical means, a plurality of electrically operable initiators; a method of operating the said means; and a power supply means for supplying power to the activating means.

In the specification, the term "explosion" is meant to include chemical reactions occurring at a relatively fast rate, such as in blasting operations, as well as chemical reactions of a relatively slower rate as with projectile propellants.

According to a first aspect of the invention there is provided an activating means for sequentially activating a plurality of electrically actuable initiators, including a series of activating modules, first connecting means for connecting each of the activating modules to a different one of the initiators, each activating module having a controllable, electrically operable switch means and disabling means for disabling the switch means of the immediately succeeding activating module, each disabling means being such that it disables the switch means of the succeeding activating module until the initiator associated with its own activating module has been activated, second connecting means for connecting the disabling means of each activating module to the switch means of the succeeding activating module, and third connecting means for connecting the activating modules to a power supply means, with the activating modules of the series being arranged in two sets such that the two sets of activating modules are alternately and repeatedly energised by the power supply means.

By this means, the initiators may be sequentially activated as the sequentially enabled activating modules in the series are energised.

Conveniently, the first activating module of the series and every successive alternate activating module may comprise a first set and the second activating module of the series and every successive alternate activating module may comprise the second set.

Each switch means of the activating modules may be uni-directional with the switch means of the two sets being connected with opposite polarity to each other. All the activating modules may then be supplied with power from the power supply means with the two sets of activating modules being alternately energised by means of reversals in the polarity of the power supplied to the activating modules.

Alternatively, the two sets of activating modules may be supplied with power independently via separate power supply cables, such that power is supplied alternately to the two sets to energise them alternately.

The switch means may be electronic solid state devices, such as S.C.R.'s, bi-polar transistors, or the like. Preferably the switch means are S.C.R.'s.

In the preferred embodiment, the first connecting means may be such as to connect one or more initiators electrically in series with the switch means of its associated activating module. Further, an element the resistance of which changes substantially when the initiator is activated may be utilised to assist in disabling the switch means. As initiators normally have a low resistance value prior to activation and a high resistance value subsequent to activation, the initiators may be utilised in disabling the switch means. Thus, the first connecting means associated with the initiators may comprise the disabling means. Accordingly, the second connecting means may connect the junction between the first connecting means and the switch means of each activating module with the switch means of its succeeding activating module. In order to ensure effective operation of the activating means a fusible link may be provided in parallel with the first connecting means so that if a defective initiator is utilised having an initial high value of resistance, the fusible link having a low resistance value prior to activation will disable the succeeding activating module. For example, if the switch means comprise S.C.R.'s, the gates of the S.C.R.'s may be clamped to a sufficiently low voltage level to prevent firing of the S.C.R.'s until the initiator of the preceding activating module has been activated. Suitable biassing elements and blocking diodes may accordingly be provided.

The initiators may be electrically operated detonators, electrically operable ignitor cord ignitors, electrically operable safety fuse ignitors or the like. The initiators may further be of the delay type, i.e. they may be adapted to initiate the explosion a predetermined time interval after having been activated. This may be accomplished by chemical means. By this means, all of the initiators may be activated before the explosions are initiated or some or all of the initiators may be activated after the explosions are initiated. Preferably, all of the initiators are activated before the explosions are initiated.

It is to be understood that the time periods between successive activations of the initiators are not determined by the activating modules themselves, but by the manner in which the sets of activating modules are energised.

Thus, according to a second aspect of the invention there is provided a method of sequentially activating a plurality of electrically operable initiators by means of a plurality of activating modules connected to a power supply means and to one another in a series, each activating module being associated with a different one of the initiators, with the activating modules being interconnected such that each of the activating modules disables the immediately succeeding activating module until its own initiator has been activated, and with the activating modules being arranged in two sets, including controlling the supply of power to the activating modules so as to alternately and repeatedly energise one set of activating modules and then the other.

As indicated earlier, power may be supplied simultaneously to all of the activating modules and the polarity of the supplied power reversed, in order to selectively energise the two sets of activating modules or power may be independently and alternately supplied to the two sets of activating modules.

As the activating means will normally be utilised in a hostile environment, each activating module may be encased in a suitable hermetically-sealed housing. The first connecting means may then comprise a suitable socket connector in which a plug may be received to connect the initiator to the activating module. The second and third connecting means may comprise cables permanently connected to the activating modules. The activating means may thus be provided as a harness comprising a chain of the interconnected activating modules. The required number of activating modules may then be utilised as required.

Further according to the invention there is provided a power supply means for supplying power to the activating means of the invention, the power supply means including either a reversal means for cyclically reversing the polarity of electric power supplied to the activating means, or output terminals and switching means for supplying power alternately and repeatedly to the output terminals.

The reversal means or the switching means may be variable to vary the rate at which the activating modules are energised. Conveniently, the reversal means and the switching means may comprise a suitable oscillator and a suitable relay. Thus, the activating modules may be energised in a pulsed manner. The power supply means may further be adapted to be automatically disabled after a predetermined number of the activating modules have been energised. Thus, the power supply means may include counting means for counting the number of times the polarity is reversed or the number of times power is switched between the output terminals and for disabling the power supply means accordingly. In order to ensure that only authorised personnel may operate the power supply means, it may include a key operated switch. As a safety feature, the power supply means may further include a variable timing means for automatically actuating the reversal means or the switching means after a predetermined interval of time so that personnel may have time to get clear of the area before the explosions are initiated.

The invention will now be described by way of examples, with reference to the accompanying drawings, in which.

Figure 1:
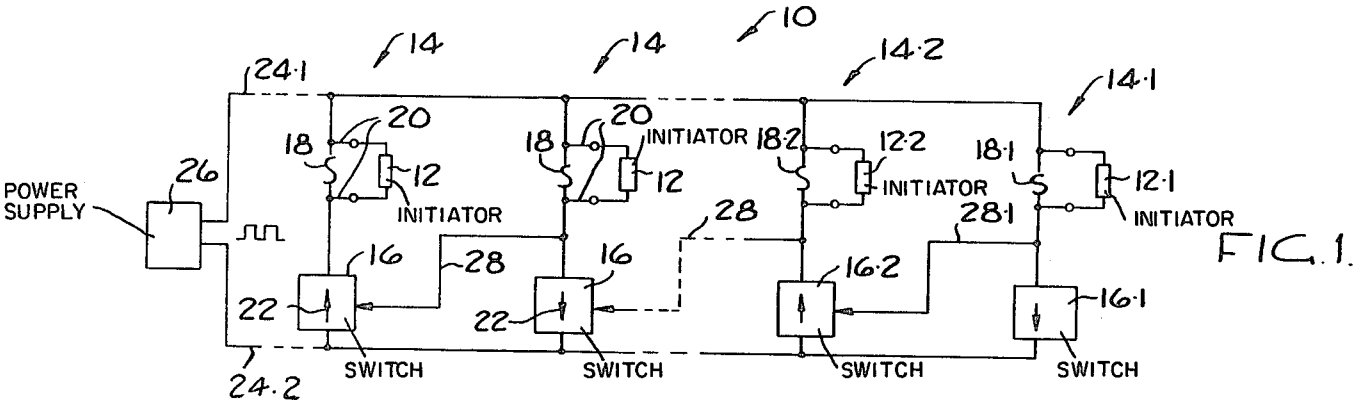
FIG. 1 shows a block diagram of one embodiment of the activating means.

Referring to FIG. 1, an activating means is shown generally by reference numeral 10, for sequentially activating a plurality of initiators 12. Each initiator 12 is an electrically operated detonator of the delay type, for initiating an explosion in blasting explosive. The activating means 10 comprises a plurality of activating modules 14. Each activating module 14 comprises a controllable, electrically operated, normally-open switch 16 connected in series with a fusible shorting link 18 across which is provided connections that are connected to the initiators 12. Each switch 16 is uni-directional, i.e. it allows current to flow in only one direction, as indicated by the arrows 22. The activating modules 14 are connected in parallel with each other across two supply cables 24.1 and 24.2 which are connected at one end to a power supply unit 26. As shown, alternate activating modules 14 have their switches 16 with opposite polarity. The power supply unit 26 cyclically reverses the polarity of the electric power supplied to the supply cables 24.1 and 24.2 and will be considered in more detail hereinafter with reference to FIG. 3.

The switches 16 may be disabled by means of disabling connections 28 between the activating modules 14. The switch 16.1 of the first activating module 14.1, i.e. the activating module furthest from the power supply unit 26, is not disabled, the succeeding activating modules each being disabled by its preceding activating module.

In operation, when the power supply unit 26 first supplies power to the activating means 10, with the supply cable 24.1 positive with respect to the supply cable 24.2, as the switch 16.1 of the first activating module 14.1 is not disabled, current flows through it, activating the initiator 12.1 and fusing the link 18.1. As the switch 16.2 of the next activating module and every successive alternate unit is reverse biassed, no current flow occurs through these switches. Further, as the initiators 12 of the activating modules 14 preceding all the other activating modules (whose switches 16 are forward biassed) have not been activated, thus disabling the switches of these other activating modules, no current flow occurs through these switches and no other initiators are activated. When the power supply 26 reverses the supply polarity to make the supply cable 24.2 positive with respect to the supply cable 24.1, as the switch 16.2 of the second activating module 14.2 is now forward biassed, and as the initiator 12.1 has been activated, the switch 16.2 is no longer disabled and it conducts current, activating its initiator 12.2 and fusing the link 18.2. By this means, each time the polarity of the supplied power reverses a successive initiator is activated.

After the time delay of the first initiator 12.1, it initiates the first explosion, and so on with the remaining initiators 12. The rate of reversal of the supplied power is sufficiently fast so that the last initiator 12 is activated, before the first explosion has been initiated.

As the disabling connections 28 normally operate to disable the switches 16 by means of the conductivity of the initiators 12 before they have been activated, in the event that one of the initiators 12 is defective or has not been correctly connected to the connections 20, the fusible links 18 are provided to ensure activation of the initiators 12 in the correct sequence. If the fusible links 18 are not provided and one of the initiators 12 is defective, then not only the initiators succeeding the first initiator 12.1 will be activated in sequence, but a further sequence of activations will occur simultaneously from the defective initiator.

Figure 2:
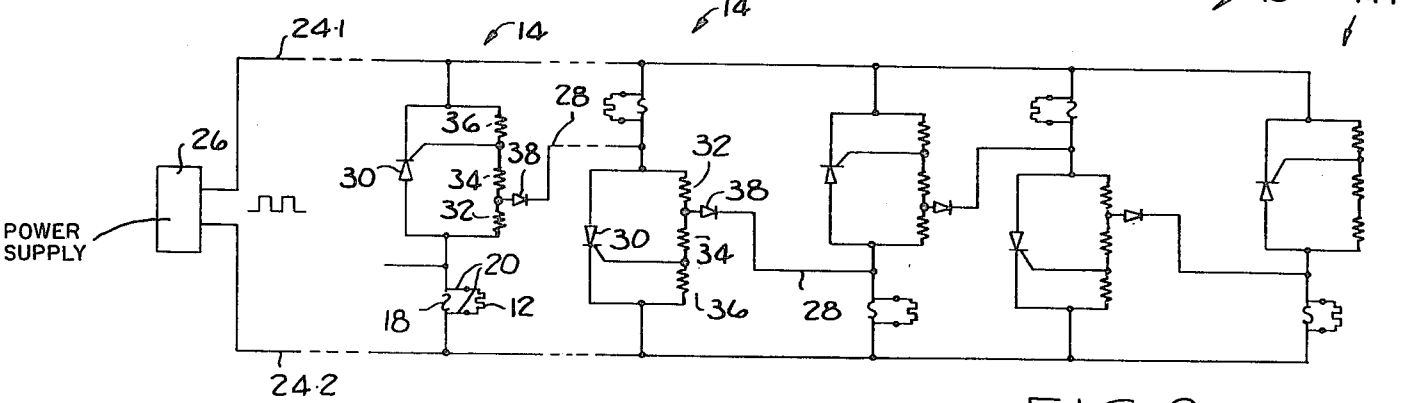
FIG. 2 shows the circuit diagram of an activating means similar to that shown in FIG. 1.

Referring to FIG. 2, a particular embodiment of the activating means 10 is shown, utilising S.C.R.'s 30 as the switches. As shown, the cathode of each S.C.R. 30 is connected to one or the other of the supply cables 24.1, 24.2, and the anode of each S.C.R. 30 is connected to the other supply cable 24.2, 24.1 (as the case may be) via an initiator 12 in parallel with the fusible link 18. Across the anode and cathode of each S.C.R. 30 is connected a series of network of three biassing resistors 32, 34 and 36. The gate of each S.C.R. 30 is directly connected to the junction between the resistors 34 and 36. The junction between the resistors 32 and 34 is connected, via a blocking diode 38, to the junction between the anode of the S.C.R. and the initiator 12 of the preceding activating module 14, by means of the disabling connection 28.

In operation, if the preceding initiator 12 has not been activated, the gate of the S.C.R. 30 is held at a sufficiently low voltage to disable the S.C.R. Once the initiator 12 has been activated, so tht it and its fusible link 18 are both open-circuited, when the correct polarity is applied to the S.C.R., its gate 30 receives a switch-on signal from the voltage divider network of resistors 32, 34 and 36. Naturally, the resistor 32 has a sufficiently large resistance to prevent sufficient current flow through it and its associated blocking diode 38 to activate its own associated initiator 12 and the initiator of the adjacent activating module 14.

Figure 3:
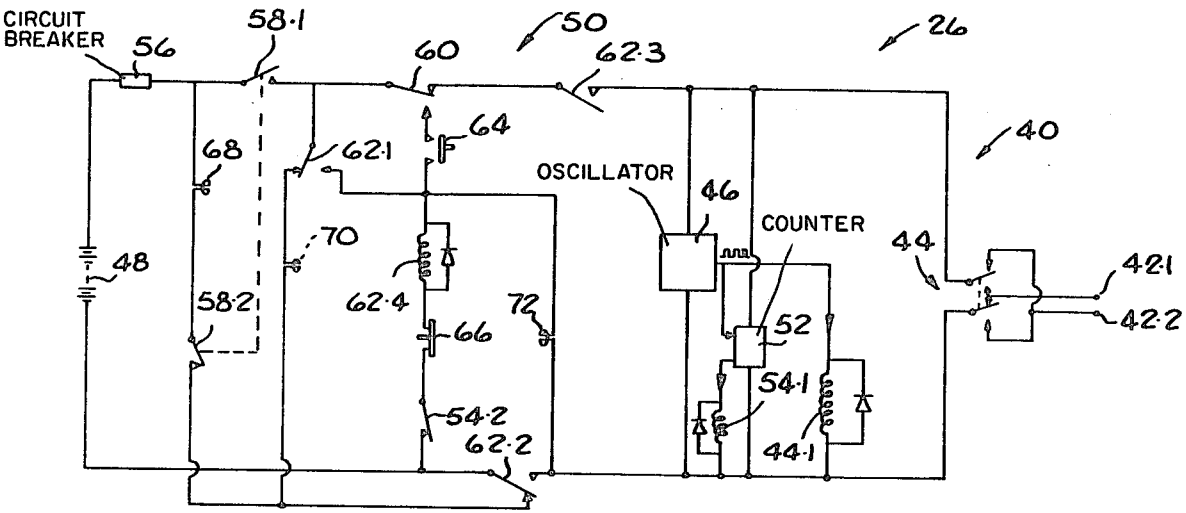
FIG. 3 shows the circuit diagram of a drive unit for driving the activating means of FIGS. 1 and 2.

Referring to FIG. 3, the power supply unit 26 is shown. The power supply unit 26 includes reversal means 40 for reversing the polarity of the power supplied to connectors 42.1 and 42.2 to which the supply cables 24.1 and 24.2 of FIGS. 1 and 2 are connected. The reversal means 40 comprises a two-pole change-over relay 44, the coil of which 44.1 is driven by a square wave, variable frequency oscillator 46. The change-over relay 44 and the oscillator 46 are supplied with D.C. power from a battery or accumulator 48, via a control arrangement 50. The oscillator 46 also supplies pulses to a counter 52 which energises the coil 54.1 of a switch-off relay, having a normally closed contactor 54.2, when a predetermined number (that may be varied) of pulses has been counted. The oscillator 46 and the counter 52 may include discrete and/or I.C. devices.

The control arrangement 50 comprises a circuit breaker 56; a two-pole key-operated switch having contactors 58.1 and 58.2; a mechanical timer comprising a single-pole double-throw switch 60; a hold-on relay having two double-throw contactors 62.1, 62.2 and a normally-open contactor 62.3 and a coil 62.4; a manually operable, normally-open spring-loaded start switch 64 and a manually operable, normally-closed, spring-loaded stop switch 66. Three indicator lamps 68, 70 and 72 are also provided to indicate the state of the control arrangement 50. The interconnection of these components is as indicated in FIG. 3.

In operation, when the key-operated switch is operated, opening the contactor 58.2 and closing the contactor 58.1, the lamp 68 is extinguished and the lamp 70 energised. The timer is set manually, switching the contactor 60. If the start switch 64 is operated, current flows through the coil 62.4 and switches the contactors 62.1 and 62.2 and closes the contactor 62.3. The relay coil 62.4 is thus kept energised via the contactor 62.1 and the reversal means 40 is enabled via the contactors 62.3 and 62.2. Further the indicating lamp 70 is extinguished and the indicating lamp 72 is energised. If the timer is not first set, then operation of the start switch 64 will have no effect. After the time interval determined by the timer, the contactor 60 switches energising the oscillator 46 and the change-over relay 44. The oscillator 46 accordingly drives the relay 44 to reverse the polarity of the power supplied to the activating means 10. After a predetermined number of pulses, the counter 52 energises the relay coil 54.1 which opens the contactor 54.2. This de-energises the relay coil 62.4 and resets the control arrangement 50. The oscillator 46 and the change-over relay 44 may also be disabled or de-energised by manually operating the stop switch 66.

Figure 4:
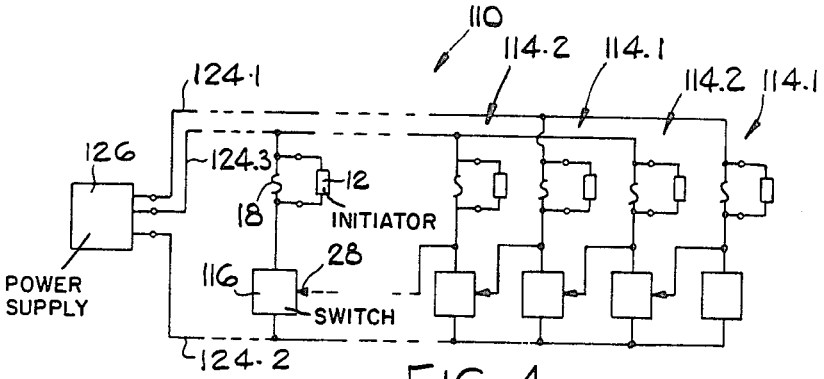
FIG. 4 shows a block diagram of a further embodiment of the activating means.

Referring now to FIG. 4, a further embodiment of an activating means 110 is shown, in which the activating modules are selectively energised by power being supplied to the activating modules independently. The activating means 110 is similar to the activating means 10 in that it has a series of activating modules 114 connected in parallel between supply cables, with each activating module 114 having a controllable, electrically operable normally-open switch 116, connected in series with the parallel arrangement of the fusible links 18 and the initiators 12; and with the switches 116 being disabled by means of the disabling connections 28. However, with this activating means 110, the switches 116 need not be uni-directional; the odd-numbered activating modules 114.1 are connected in parallel between a power supply cable 124.1 and a power return cable 124.2 whereas the even-numbered activating modules 114.2 are connected in parallel between a power supply cable 124.3 and the power return cable 124.2; the power supply unit 126 is adapted to supply power alternately either to the power supply cable 124.1 or the power supply cable 124.3, whilst connecting the power supply cable 124.1 or 124.3 that is not being supplied with power to the power return cable 124.2 thereby to prevent activation of the relevant initiators 12.

It will be readily understood that the operation of the activating means 110 is similar to that of the activating means 10.

Figure 5:
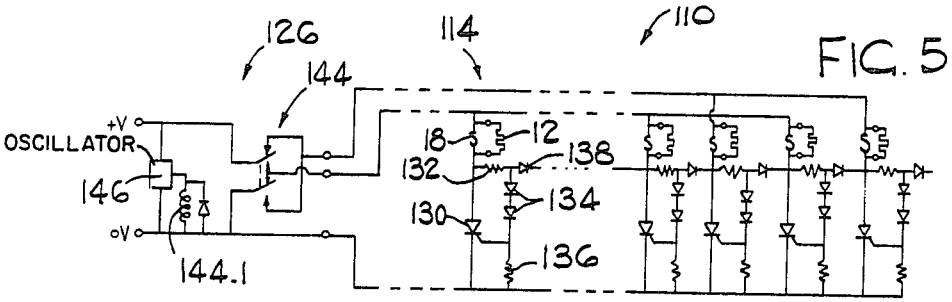
FIG. 5 shows the circuit diagram of an activating means similar to that of FIG. 4.

A circuit diagram of an activating means 110 is shown in FIG. 5. As shown, each activating module 114 has an S.C.R. 130 as the switch 116 in series with the initiators 12 and the fusible links 18, with the gates of the S.C.R.'s 130 being biassed by means of resistors 132 and 136 and diodes 134, and being disabled via blocking diodes 138. As will be understood, the diodes 134 are to compensate for the forward voltage drop across the blocking diode 138 to ensure that the S.C.R.'s are disabled.

The power supply unit 126, similarly with the power supply unit 26 of the circuit shown in FIG. 3, has a square-wave oscillator 146 which drives the coil 144.1 of a change-over relay 144. It is understood that the power supply unit 126 also has the counter 52 and the control arrangement 50 of the power supply unit 26.

Figure 6:
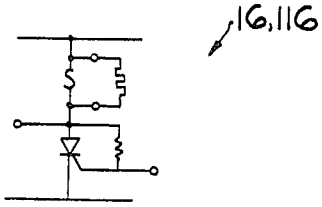
FIGS. 6 and 7 show the circuit diagrams of activating modules which may be used with the activating means of FIGS. 1 and 4.
Figure 7:
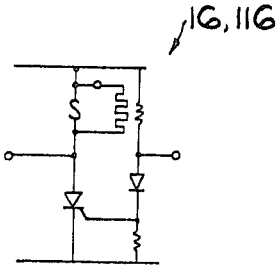

Referring finally to FIGS. 6 and 7, circuit diagrams are shown for various embodiments of the activating modules 16 and 116, with various biassing networks for the S.C.R. It will be appreciated by those skilled in the art, that as shown in FIG. 7, the biassing networks for the S.C.R.'s of the activating modules shown in FIGS. 2, 5 and 6 may also be supplied with power directly from the supply cable.

It is to be understood that the activating modules shown in FIGS. 2, 5, 6 and 7 may be utilised in the activating means shown in FIGS. 1 and 4.

We claim:

1. An activating means for sequentially activating a plurality of electrically actuable initiators, including a series of activating modules arranged in first and second sets, first connecting means for connecting each of the activating modules to a different one of the initiators, each activating module having a controllable, electrically operable switch means and disabling means for disabling the switch means of the immediately succeeding activating module, each disabling means being such that it disables the switch means of the succeeding activating module until the initiator associated with its own activating module has been activated, second connecting means for connecting the disabling means of each activating module to the switch means of the succeeding activating module, and third connecting means for connecting the activating modules to a power supply means and including separate power supply cables for supplying power independently to either the first or the second set of activating modules thereby to energize either the first or the second set of activating modules.

2. An activating means as claimed in claim 1, in which the first activating module of the series and every successive alternate activating module comprises the first set and the second activating module of the series and every successive alternate activating module comprises the second set.

3. An activating means as claimed in claim 1, in which the switch means are electronic solid state devices.

4. An activating means as claimed in claim 1, in which the first connecting means connect each initiator electrically in series with the switch means of its associated activating module.

5. An activating means as claimed in claim 4, in which the second connecting means connect the junctions between the first connecting means and the switch means of each activating module with the switch means of each succeeding activating module.

6. An activating means as claimed in claim 4, which includes a fusible link electrically in parallel with each first connecting means.

7. An activating means for sequentially activating a plurality of electrically actuable initiators, including a series of activating modules arranged in two sets, first connecting means for connecting each of the activating modules to a different one of the initiators, each activating module having a controllable, electrically operable, uni-directional switch means and disabling means for disabling the switch means of the immediately succeeding activating module, each disabling means being such that it disables the switch means of the succeeding activating module until the initiator associated with its own activating module has been activated, second connecting means for connecting the disabling means of each activating module to the switch means of the succeeding activating module, a power supply means which includes an oscillator and a switch-over relay for cyclically reversing the polarity of electric power supplied to the activating modules, and a pair of supply cables connecting the activating modules to the power supply means, with the switch means being connected between the supply cables, and the switch means of the first set of activating modules being connected with opposite polarity to the switch means of the second set of activating modules, such that the two sets of activating modules may be alternately and repeatedly energized by reversal of the polarity of the power supplied from the power supply means.

8. An activating means for sequentially activating a plurality of electrically actuable initiators, including a series of activating modules arranged in two sets, first connecting means for connecting each of the activating modules to a different one of the initiators, each activating module having a controllable, electrically operable, uni-directional switch means and disabling means for disabling the switch means of the immediately succeeding activating module, each disabling means being such that it disables the switch means of the succeeding activating module until the initiator associated with its own activating module has been activated, second connecting means for connecting the disabling means of each activating module to the switch means of the succeeding activating module, a power supply means which includes reversal means for cyclically reversing the polarity of electric power supplied to the activating means and counting means for counting the number of times the polarity is reversed and for disabling the power supply means after the polarity has been reversed a predetermined number of times, and a pair of supply cables connecting the activating modules to the power supply means, with the switch means being connected between the supply cables, and the switch means of the first set of activating modules being connected with opposite polarity to the switch means of the second set of activating modules, such that the two sets of activating modules may be alternately and repeatedly energized by reversal of the polarity of the power supplied from the power supply means.

9. An activating means for sequentially activating a plurality of electrically actuable initiators, including a series of activating modules arranged in two sets, first connecting means for connecting each of the activating modules to a different one of the initiators, each activating module having a controllable, electrically operable, uni-directional switch-means and disabling means for disabling the switch means of the immediately succeeding activating module, each disabling means being such that it disables the switch means of the succeeding activating module until the initiator associated with its own activating module has been activated, second connecting means for connecting the disabling means of each activating module to the switch means of the succeeding activating module, and a power supply means which includes reversal means for cyclically reversing the polarity of electric power supplied to the activating means and variable timing means for automatically actuating the reversal means after a predetermined period of time, and a pair of supply cables connecting the activating modules to the power supply means, with the switch means being connected between the supply cables, and the switch means of the first set of activating modules being connected with opposite polarity to the switch means of the second set of activating modules, such that the two sets of activating modules may be alternately and repeatedly energized by reversal of the polarity of the power supplied from the power supply means.

10. An activating means as claimed in claim 9, in which the reversal means is variable to vary the rate of reversal of polarity.

11. An activating means as claimed in claim 9, which includes a key operated switch.

12. An activating means for sequentially activating a plurality of electrically actuable initiators, including a series of activating modules arranged in first and second sets, first connecting means for connecting each of the activating modules to a different one of the initiators, each activating module having a controllable, electrically operable switch means and disabling means for disabling the switch means of the immediately succeeding activating module, each disabling means being such that it disables the switch means of the succeeding activating module until the initiator associated with its own activating module has been activated, second connecting means for connecting the disabling means of each activating module to the switch means of the succeeding activating module, a power supply means having two output terminals and switching means for supplying power alternately and repeatedly to the output terminals, and power supply cables connecting the activating modules to the output terminals of the power supply means, for supplying power independently to either the first or the second set of activating modules thereby to energize either the first or the second set of activating modules.

13. A power supply means suitable for supplying power to an activating means for sequentially activating a plurality of electrically actuable initiators, the activating means including a series of activating modules arranged in first and second sets, first connecting means for connecting each of the activating modules to a different one of the initiators, each activating module having a controllable, electrically operable switch means and disabling means for disabling the switch means of the immediately succeeding activating module, each disabling means being such that it disables the switch means of the succeeding activating module until the initiator associated with its own activating module has been activated, second connecting means for connecting the disabling means of each activating module to the switch means of the succeeding activating module, and third connecting means for connecting the activating modules to the power supply means and including separate power supply cables for supplying power independently to either the first or the second set of activating modules thereby to energize either the first or the second set of activating modules, the power supply means including two output terminals; and switching means for supplying power alternately and repeatedly to the output terminals.

14. A power supply means as claimed in claim 13, in which the switching means is variable to vary the rate at which power is supplied to the output terminals.

15. A power supply means as claimed in claim 13, in which the switching means comprises an astable multivibrator and a relay.

16. A power supply means as claimed in claim 13, which includes counting means for counting the number of times power is switched between the output terminals and for disabling the power supply means when the power has been switched a predetermined number of times.

17. A power supply means as claimed in claim 13, which includes a key operated switch.

18. A power supply means as claimed in claim 13, which includes variable timing means for automatically actuating the switching means after a predetermined interval of time.

19. A power supply means suitable for supplying power to an activating means for sequentially activating a plurality of electrically actuable initiators, the activating means including a series of activating modules arranged in two sets, first connecting means for connecting each of the activating modules to a different one of the initiators, each activating module having a controllable, electrically operable, uni-directional switch means and disabling means for disabling the switch means of the immediately succeeding activating module, each disabling means being such that it disables the switch means of the succeeding activating module until the initiator associated with its own activating module has been activated, second connecting means for connecting the disabling means of each activating module to the switch means of the succeeding activating module, and a pair of supply cables for connecting the activating modules to the power supply means, with the switch means being connected between the supply cables, and the switch means of the first set of activating modules being connected with opposite polarity to the switch means of the second set of activating modules, such that the two sets of activating modules may be alternately and repeatedly energized by reversal of the polarity of the power supplied from the power supply means, the power supply means including an oscillator and a switchover relay for cyclically reversing the polarity of electric power supplied to the activating modules.

20. A power supply means suitable for use with an activating means for sequentially activating a plurality of electrically actuable initiators, the activating means including a series of activating modules arranged in two sets, first connecting means for connecting each of the activating modules to a different one of the initiators, each activating module having a controllable, electrically operable, uni-directional switch means and disabling means for disabling the switch means of the immediately succeeding activating module, each disabling means being such that it disables the switch means of the succeeding activating module until the initiator associated with its own activating module has been activated, second connecting means for connecting the disabling means of each activating module to the switch means of the succeeding activating module, and a pair of supply cables for connecting the activating modules to the power supply means, with the switch means being connected between the supply cables, and the switch means of the first set of activating modules being connected with opposite polarity to the switch means of the second set of activating modules, such that the two sets of activating modules may be alternately and repeatedly energized by reversal of the polarity of the power supplied from the power supply means, the power supply means including reversal means for cyclically reversing the polarity of electric power supplied to the activating means and counting means for counting the number of times the polarity is reversed and for disabling the power supply means after the polarity has been reversed a predetermined number of times.

21. A power supply means for supplying power to an activating means for sequentially activating a plurality of electrically actuable initiators, the activating means including a series of activating modules arranged in two sets, first connecting means for connecting each of the activating modules to a different one of the initiators, each activating module having a controllable, electrically operable, uni-directional switch means and disabling means for disabling the switch means of the immediately succeeding activating module, each disabling means being such that it disables the switch means of the succeeding activating module until the initiator associated with its own activating module has been activated, second connecting means for connecting the disabling means of each activating module to the switch means of the succeeding activating module, and a pair of supply cables for connecting the activating modules to the power supply means, with the switch means being connected between the supply cables, and the switch means of the first set of activating modules being connected with opposite polarity to the switch means of the second set of activating modules, such that the two sets of activating modules may be alternately and repeatedly energized by reversal of the polarity of the power supplied from the power supply means, the power supply means including reversal means for cyclically reversing the polarity of electric power supplied to the activating means and variable timing means for automatically actuating the reversal means after a predetermined period of time.

22. A method of sequentially activating a plurality of electrically operable initiators by means of a plurality of activating modules connected to a power supply means and to one another in a series, each activating module being associated with a different one of the initiators, with the activating modules being interconnected such that each of the activating modules disables the immediately succeeding activating module until its initiator has been activated, and with the activating modules being arranged in two sets, including supplying power alternately and repeatedly to one set of activating modules and then to the other set so as to alternately and repeatedly energize said one set of activating modules and then said other set.

23. A method as claimed in claim 22, in which the activating modules are disabled by means of an element which has a low resistance value before the initiator has been activated and a high resistance value afterwards.

* * * * *